US005560221A

United States Patent [19]

Snelling et al.

[11] Patent Number: 5,560,221

[45] Date of Patent: Oct. 1, 1996

[54] BEVERAGE COOLING APPARATUS WITH ICE AGITATING DISPENSER

[75] Inventors: Jeff Snelling, Griffin, Ga.; Junichi Hida, Aichi, Japan

[73] Assignee: Hoshizaki America, Inc., Peachtree City, Ga.

[21] Appl. No.: 312,789

[22] Filed: Sep. 27, 1994

[51] Int. Cl.[6] ..... F25C 5/18

[52] U.S. Cl. ..... 62/344; 62/389; 62/396; 62/460; 62/379

[58] Field of Search ..... 62/389, 398, 344, 62/390, 396, 137, 459, 460, 461, 379; 222/146.6, 412, 185

[56] References Cited

U.S. PATENT DOCUMENTS

| | | | |
|---|---|---|---|
| 13,679 | 1/1914 | Keyes . | |
| 745,889 | 12/1903 | McPherson . | |
| 752,810 | 2/1904 | Sweeney . | |
| 1,237,050 | 8/1917 | Kafer . | |
| 2,096,481 | 10/1937 | Frykdahl . | |
| 2,677,249 | 5/1954 | Mason et al. | 62/344 |
| 3,517,860 | 6/1970 | Whalen . | |
| 3,739,842 | 6/1973 | Whalen . | |
| 4,215,803 | 8/1980 | Schafer . | |
| 4,227,377 | 10/1980 | Miller . | |
| 4,300,359 | 11/1981 | Koeneman et al. . | |
| 4,346,824 | 8/1982 | Miller et al. . | |
| 4,429,543 | 2/1984 | Fischer . | |
| 4,513,892 | 4/1985 | Koeneman et al. . | |
| 4,641,763 | 2/1987 | Landers et al. . | |
| 5,249,710 | 10/1993 | Hassell et al. | 62/398 |

FOREIGN PATENT DOCUMENTS 59-196496 12/1984 Japan .

OTHER PUBLICATIONS

REMCOR Catalogue page; EG-1001 "NICE".

REMCOR Model TJ250S-BC and REMCOR Model TJ400S-TBC Catalogue; EG-1004, "Step up with REMCOR's High & Higher Volume Ice-Beverage Dispensers".

REMCOR Model TJ90S≧BC and REMCOR Model TJ150S-BC Catalogue; EG-1030, "REMCOR The Pepsi Choice".

REMCOR Model GENESIS I Catalogue; FSP-751/EG-1006, "With the REMCOR GENESIS I Ice and Beverage Dispenser".

*Primary Examiner*—John M. Sollecito

*Attorney, Agent, or Firm*—Nikaido, Marmelstein, Murray & Oram LLP

[57] ABSTRACT

A beverage cooling system has an ice storage bin having a mechanical agitator disposed therein. The ice storage bin includes an opening at a bottom portion thereof, and the mechanical agitator is actuable to mechanically agitate ice in the ice bin and mechanically force ice through the opening. An ice guide is disposed adjacent the opening in the ice storage bin. A cold plate is disposed adjacent the ice guide. The cold plate has an inclined upper surface thereof and includes at least one beverage line disposed underneath the upper surface. The ice guide is positioned to deflect and guide ice onto the inclined upper :surface of the cold plate, wherein the ice is moved along the upper surface by mechanical force provided by an actuation of the agitator.

26 Claims, 6 Drawing Sheets

10
11c
11b
11
11a
15
9
8a
8
1
7

BEVERAGE COOLING APPARATUS WITH ICE AGITATING DISPENSER

BACKGROUND OF THE INVENTION

1. Field of the Invention

The present invention is directed to a beverage cooling apparatus wherein a cold plate is used to cool liquid beverages. The cold plate can be combined with an ice dispenser, to provide a dual purpose of cooling beverages and providing ice. In the food and beverage service industries, it is desirable to provide cold drinkable beverages and ice in an efficient manner. The present invention is directed to a system wherein beverages can be pre-cooled through a cold plate such that beverages can be served at a cooled temperature. Many major beverage manufacturers have recommended serving temperatures for their beverages, and recommend that resellers of the product serve the beverages within specific ranges. Additionally, carbonated beverages are known to hold their carbonation much longer when the beverage is served cold. In fountain type beverage systems, where carbonated beverages are served from a bulk source, the beverages must be cooled in the beverage lines to prevent excessive foaming. Additionally, ice added to pre-cooled beverage in a drinking cup does not melt excessively, thereby preventing undesirable dilution of the beverage. The present invention is directed to a beverage cooling apparatus which cools liquid beverages, such that the quality of the served beverage is as high as possible. The invention is intended to meet major beverage manufacturers requirements for serving temperature and serving quality.

2. Description of the Prior Art

A number of systems have been known wherein ice is placed on a cold plate to cool a liquid beverage. For example, U.S. Pat. No. 4,300,359, which is hereby incorporated by reference, discloses a cold plate system wherein ice in a hopper is transported through a conduit to an ice pan, to cool beverages flowing therethrough. The '359 patent teaches the use of an agitator in a hopper to agitate ice in the hopper. However, the '359 patent does not address problems caused by the known "bridging effect" which is where ice particles sit on top of the cold plate or other surface, and bridge together through melting. This bridging effect prevents fresh ice from being placed directly in contact with the cold plate, and reduces the efficiency of the thermal transfer between ice and beverage in the cold plate.

An additional problem which exists in the '359 patent is that the '359 patent does not teach any type of system wherein the ice is guided and/or moved toward the inlet side of the beverage line, to maximize the effect of the thermal transfer.

U.S. Pat. No. 752,810 discloses a water cooler wherein two ice blocks are manually placed upon cooling pipes 8 to cool water fed from an elevated water bottle. However, the '810 patent is a fully manual system, and does not teach any system wherein ice is automatically fed or forced to the cooling pipe from a separate hopper, to effectively and continuously cool beverage being fed therethrough.

SUMMARY OF THE INVENTION

An object of the present invention is to provide a beverage cooling system wherein maximum efficiency of thermal transfer between ice and beverage occurs, to effectively pre-cool beverages before being dispensed into a cup or drinking vessel. Effectiveness and efficiency of the invention is realized by utilizing an agitator to perform three functions of agitating ice in an ice hopper to prevent the ice from bridging in the hopper, to disperse ice from an ice dispenser, and to force the ice through an opening, into an ice guide, and into a chute where force from the agitator moves the ice around an inclined upper surface of the cold plate, to improve thermal transfer, prevent bridging, and ensure a flow of ice over the surface of the cold plate. The ice bin or hopper, therefore, is provided with a dispersing port which is used to dispense ice directly into a drinking vessel, before the beverage is added thereto.

The objects of the present invention are realized by a beverage cooling system which comprises an ice storage bin having a mechanical agitator disposed therein, with the ice storage bin having an opening at a bottom portion thereof. The mechanical agitator is operable to mechanically agitate ice in the ice bin and mechanically force ice through the opening in the bottom portion thereof. An ice guide is disposed adjacent the opening in the ice storage bin, and a cold plate is disposed adjacent or underneath the ice guide. The cold plate is supported on a support base such that the cold plate has an inclined upper surface, and includes at least one beverage line disposed underneath the upper surface. The ice guide is positioned to deflect and guide ice onto the inclined upper surface of the cold plate. The ice is moved along the upper surface of the cold plate by mechanical force provided by an actuation of the agitator.

The invention can include a drain trough at a lower portion of the inclined upper surface of the cold plate. The drain trough is configured to drain water from the upper surface of the cold plate as the ice thereupon melts as a result of thermal transfer between the ice and the cold plate. The inclined upper surface of the cold plate can have four edges, with three of the four edges being surrounded by a raised perimeter edge. A fourth edge, which is a lower edge, is open to allow water to drain directly into the drain trough.

For more effective cooling of the beverage, the beverage line or lines are serpentined throughout the cold plate, underneath the inclined upper surface thereof. A chute can be disposed underneath the ice guide. The chute encloses an ice path on the inclined upper surface of the cold plate, and prevents ice and water from sliding off of the upper surface of the cold plate. The chute functions to guide the water, propelled by gravity, from the inclined upper surface of the cold plate toward the drain trough. The chute is configured to prevent ice from entering and clogging the drain trough.

The ice storage bin can include an ice dispensing port at a dispensing station thereof. A switch functions to actuate the agitator to simultaneously dispense ice from the ice dispensing port, agitate the ice in the bin, and force ice through the opening in the bottom of the bin.

BRIEF DESCRIPTION OF THE DRAWINGS:

The above and other objects and the attendant advantages of the present invention will become readily apparent by reference to the following detailed description when considered in conjunction with the accompanying drawings, wherein.

Figure 2:
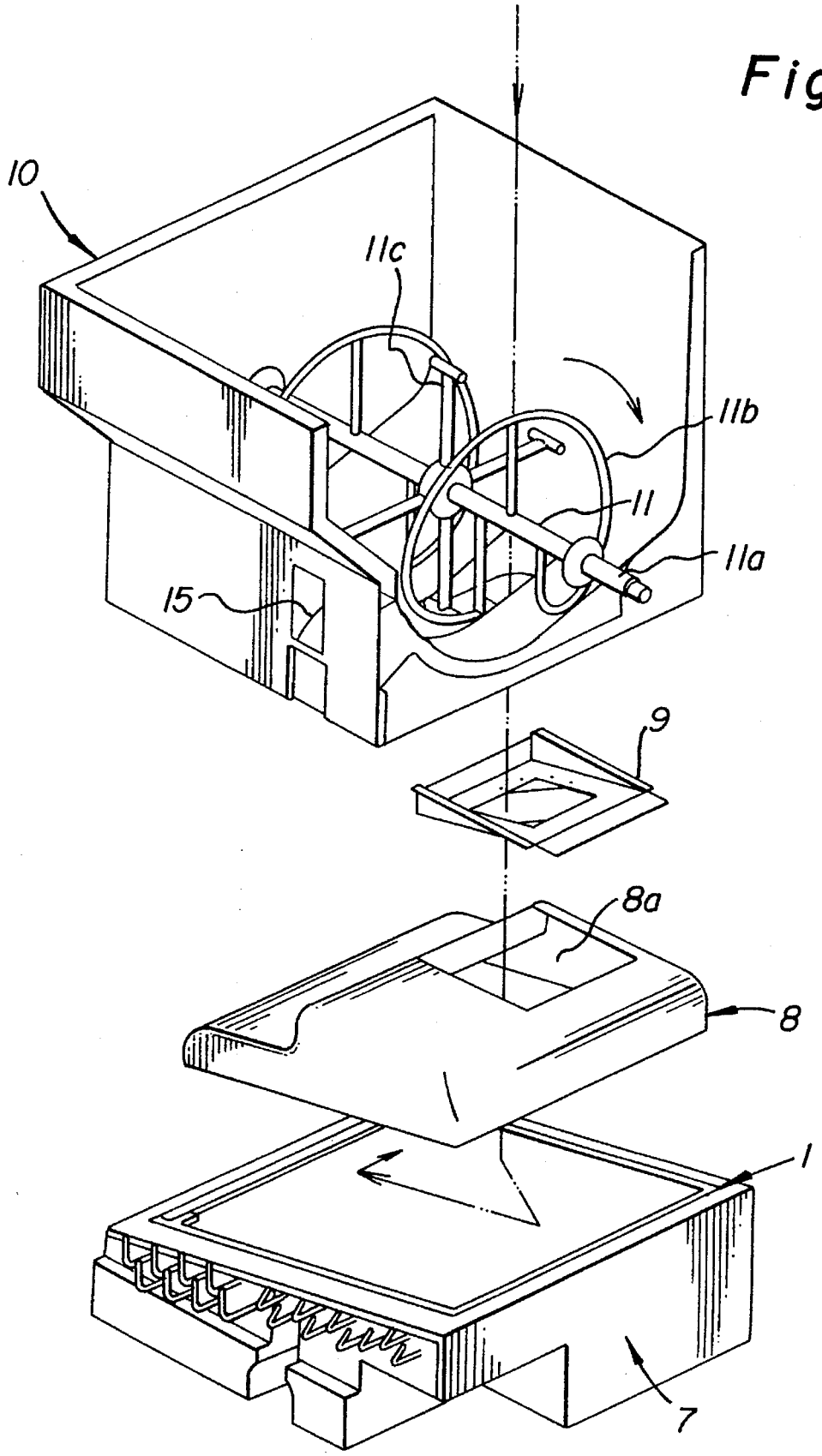
FIG. 2 is an exploded view illustrating the elements of the beverage cooling apparatus.
Figure 3:
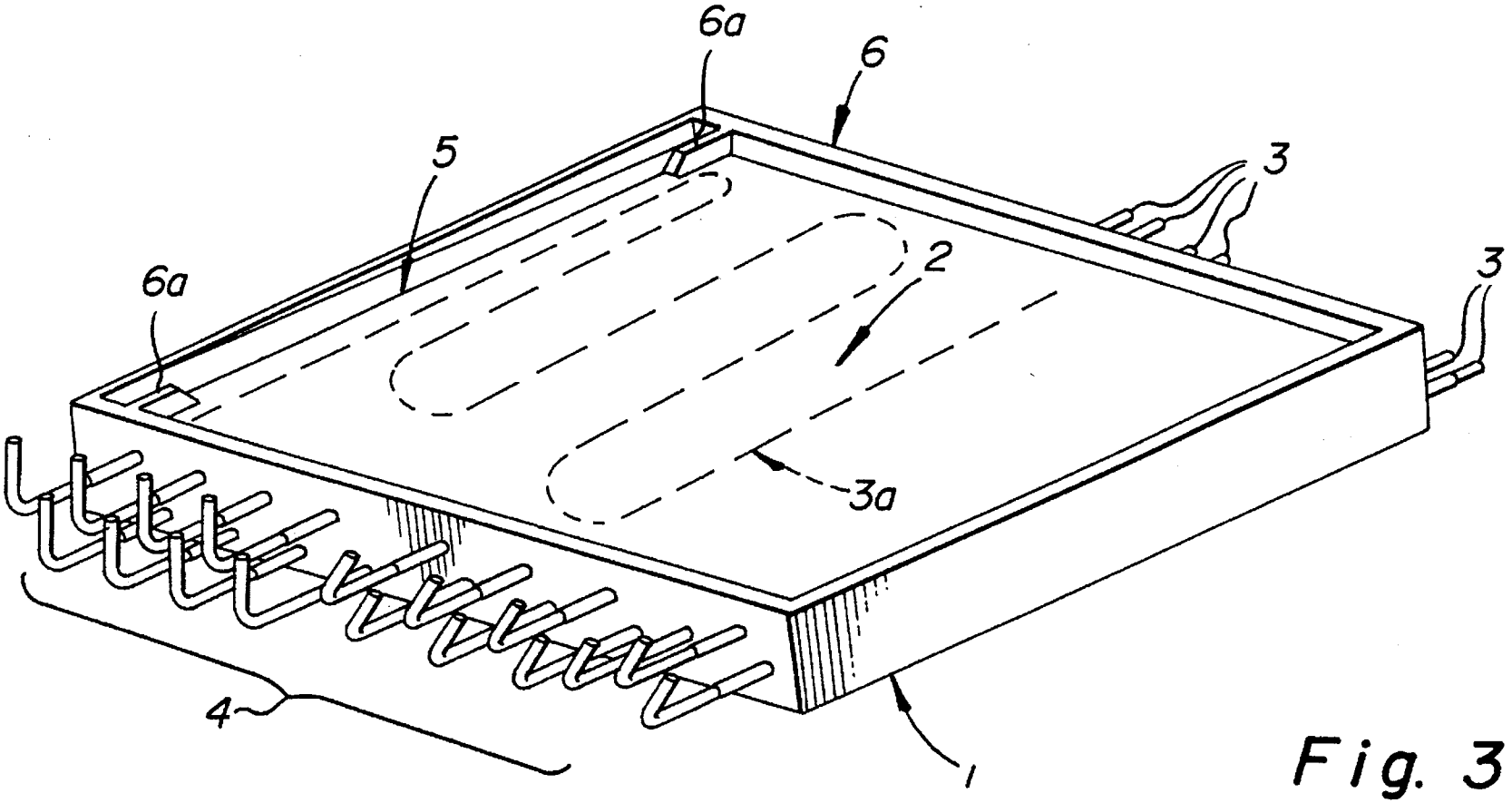
FIG. 3 is a perspective view of the cold plate of the claimed invention.
Figure 4:
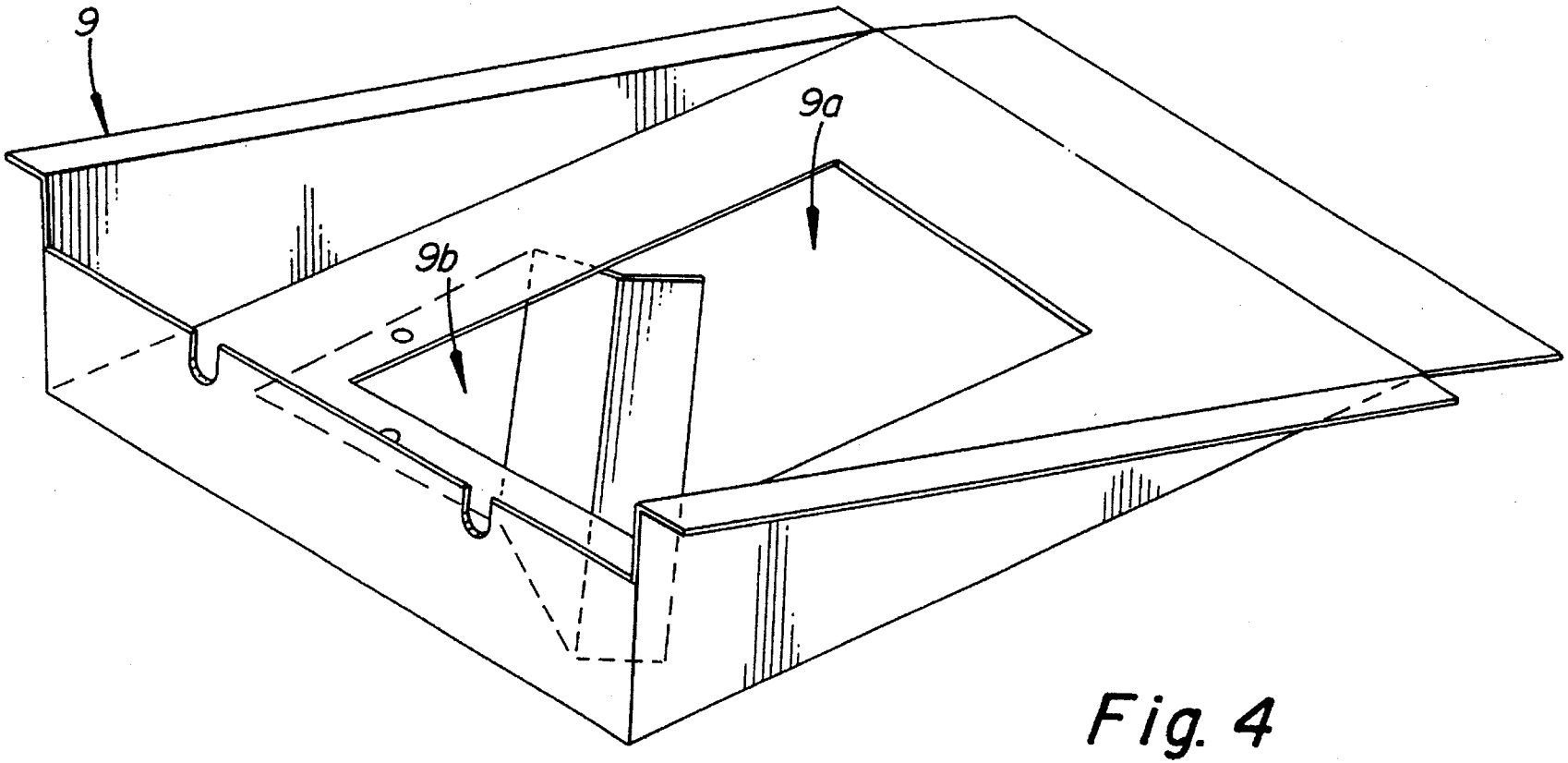
FIG. 4 is a perspective view of the ice guide of the present invention.
Figure 5:
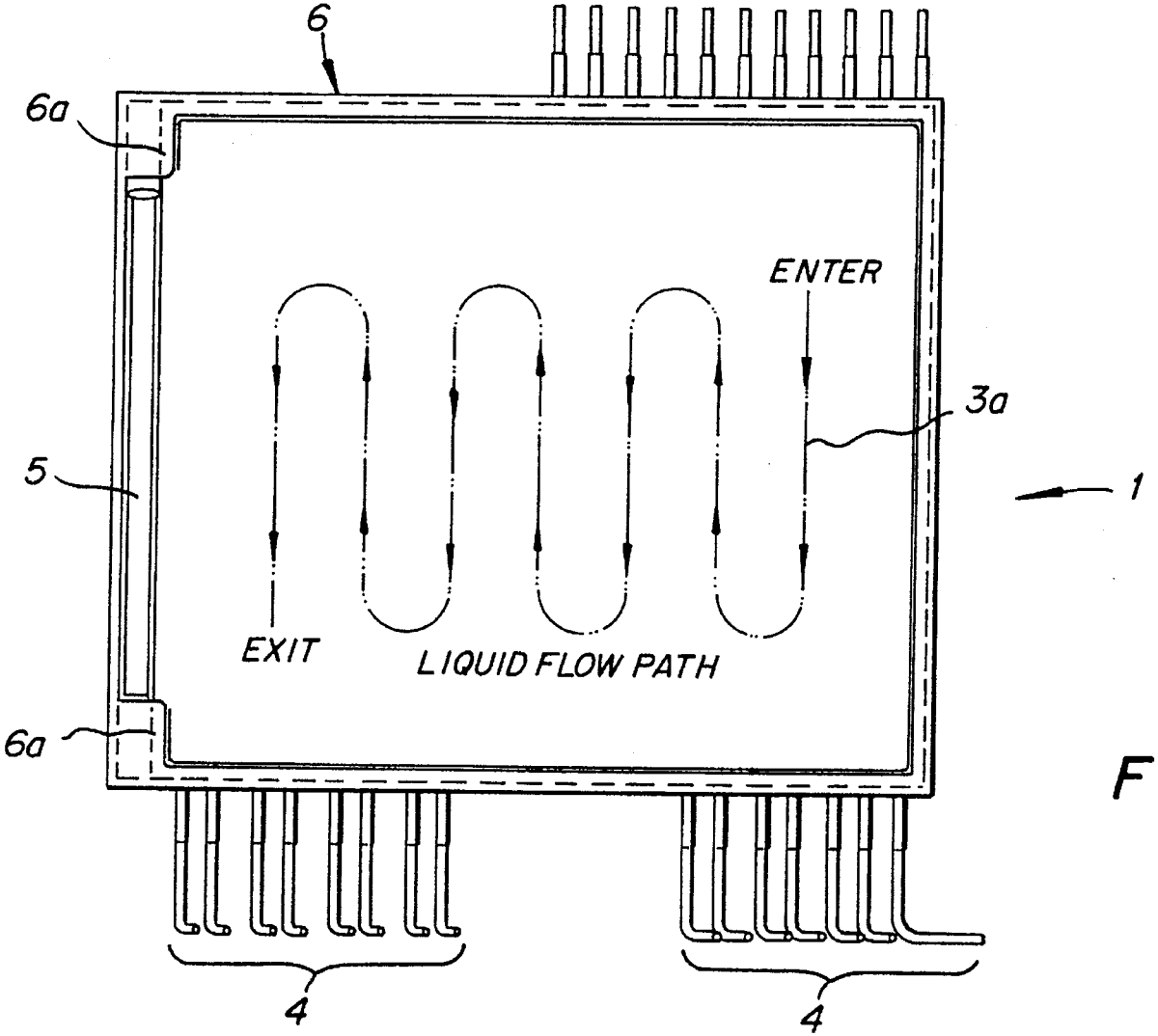
FIG. 5 is a top view of the cold plate.
Figure 6:
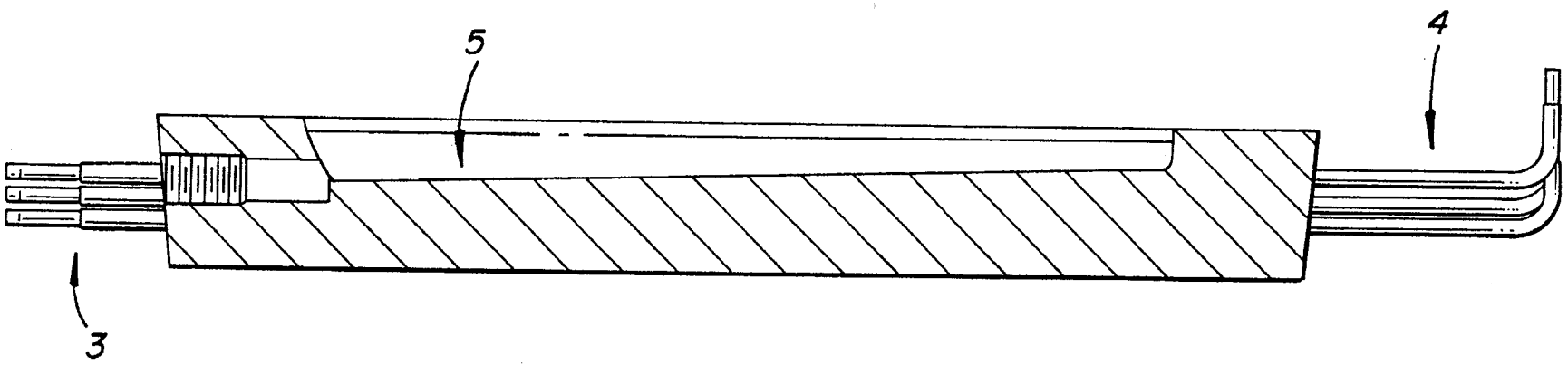
FIG. 6 is a side view of the cold plate, taken from the lower edge thereof.

DETAILED DESCRIPTION OF THE PREFERRED EMBODIMENTS:

Referring to FIG. 3, cold plate 1 has an upper surface 2 thereof. Beverage inlet ports 3 are disposed toward an upper portion of the inclined upper surface, and beverage outlet ports 4 are configured such that the beverage lines move the beverage from the upper portion to a lower portion of the inclined upper surface of the cold plate, before it reaches the outlet ports. Inlet ports 3 and outlet ports 4 are connected in the cold plate through serpentined beverage lines 3*a*, which are serpentined underneath inclined lower surface 2. A plurality of beverage lines may be configured in various horizontal planes underneath the upper surface of the cold plate. The beverage lines can be encapsulated within the cold plate with a material which supports thermal transfer between the ice and the beverage. A preferred method of manufacturing the cold plate is one where the beverage lines are pre-formed from an appropriate tubing such as stainless steel, and the cold plate is cast from a molten thermally conductive material such as aluminum. The aluminum block cold plate which results enhances thermal transfer between ice placed on top of the cold plate and liquid in the beverage lines. Cold plate 1 includes drain trough 5 at a lower surface thereof. Edges 6 of cold plate 1 surround the inclined upper surface, and provide a barrier or wall of approximately 10 mm in height therearound. The perimeter edges terminate at protrusions 6*a* at a lower portion of the cold plate; these protrusions 6*a* leave an open lower edge of the inclined upper surface of the cold plate, having no raised perimeter therearound; this open edge allows water which melts on the surface of the cold plate to drain, by force of gravity, directly into drain trough 5. The cold plate is held in the appropriate inclined position by supporting base 7 (see FIG. 2), which supports the cold plate in an inclined position such that upper surface 2 of the cold plate is inclined. The cold plate, the beverage lines, and the base form a cold plate assembly. The outer surfaces of the cold plate, except for the upper surface thereof, is desirably coated with a thermally insulating material 17, to allow the cold plate to remain at a cold temperature when ice is applied thereto.

As shown in FIG. 2, chute 8 is configured to rest within the boundary delineated by perimeter edges 6, and is prevented from sliding down or off of the drain trough by protrusions 6*a*. Chute 8 includes an opening 8*a* therein. Ice guide 9 is configured to correspond to opening 8*a* of chute 8, and ice supply bin 10 is supported above the assembly formed by cold plate 1, chute 8, and ice guide 9. Ice guide 9 can also be fixedly attached to the bottom of ice storage bin 10. The ice storage bin 10 is supported by a suitable support structure, and can be part of an overall housing 16.

Figure 1:
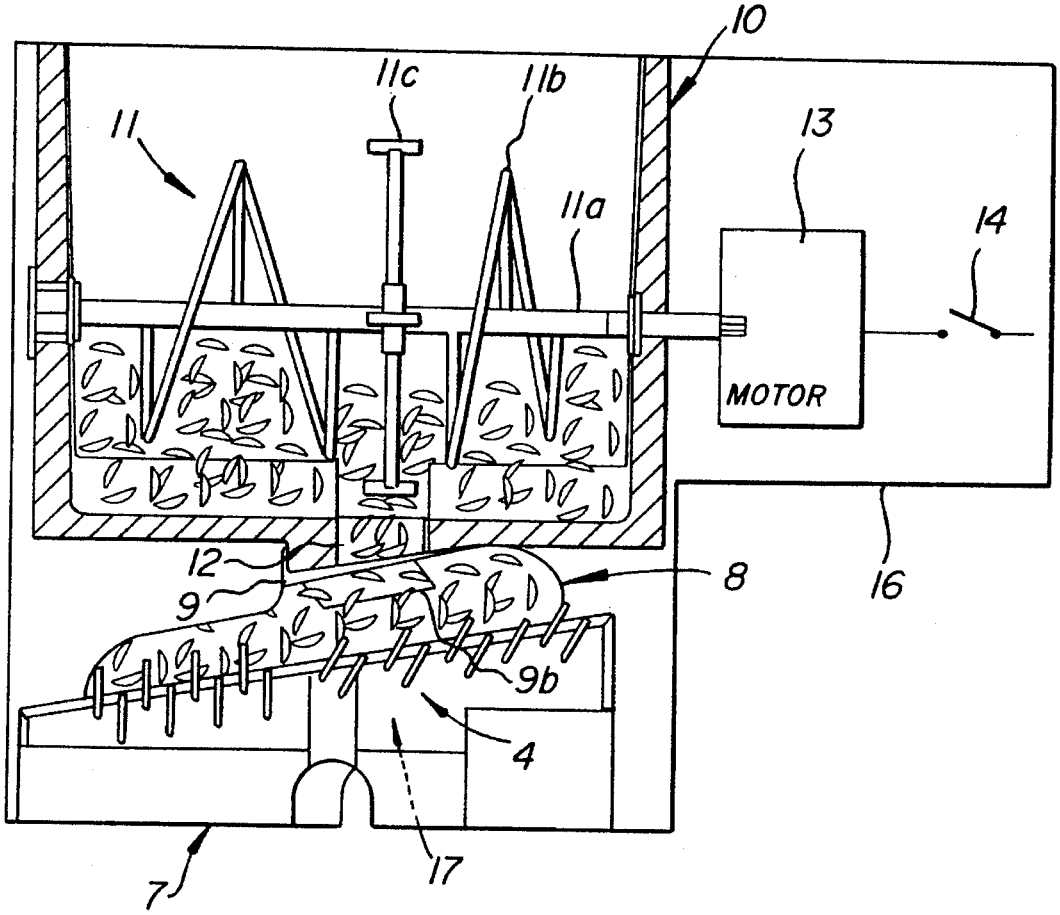
FIG. 1 illustrates a sectional view of a beverage cooling apparatus according to the present invention.

Ice storage bin 10 includes agitator 11 therein. As shown in FIGS. 1 and 2, agitator 11 comprises shaft 11*a*, ice agitator blades 11*b*, and ice movement blades 11*c*. Ice agitator blades 11*b* act to agitate the ice within the bin, to prevent the ice from bridging or freezing together. Ice movement blades 11*c* act to force the ice downward through an opening 12 provided in the bottom of ice storage bin 10. Shaft 11*a* is connected to a motor or other suitable rotating means 13, which rotates shaft 11*a* when actuated by switch 14. Ice storage bin 10 includes ice dispenser port 15, which is configured such that ice can be dispensed directly from the ice dispenser port into a drinking cup or vessel.

The beverage cooling system of the invention operates as follows: Ice storage bin 10 is filled or partially filled with ice particles of a desirable size from a suitable ice source (not shown). The ice can be provided by manual loading means, or an automatic ice maker or ice transport system feeding ice into the ice bin. As the ice bin is filled, ice, through gravity, falls through opening 12 in the bottom of the ice bin, and is guided by the ice guide 9 onto the inclined upper surface 2 of the cold plate. Gravity is sufficient to cause the ice to fall onto the cold plate until the space created by chute 8 and the upper surface of the cold plate is filled with ice. Thermal transfer immediately takes place between the ice and the cold plate, thereby cooling beverage in the beverage lines. The ice on the cold plate, therefore, immediately begins to melt, and the water drains towards drain trough 5. When a user desires beverage, typically the user will first seek to partially fill a drinking cup with ice. Ice is obtained by actuation of switch 14 to dispense ice from ice dispensing port 15. When switch 14 is actuated, the motor 13 rotates agitator 11. Upon the rotation of agitator 11, agitator blades 11*b* are rotated to agitate ice in the ice bin, and move ice particles up toward ice dispensing port 15. Agitator blades 11*b* are configured such that upon a rotation of agitator 11, ice in the ice bin is agitated to be moved toward the center of the ice bin, thereby in the general direction of opening 12. Ice movement blades 11*c* are rotated to force ice vertically downward through opening 12 of ice bin 10, through opening 9*a* in ice guide 9, and into the area defined by the inner surface of chute 8 and the upper inclined surface of the cold plate. Ice guide 9 can be configured with a deflection blade 9*b* to deflect the ice into a central or upper portion of upper surface 2 of cold plate 1. Ice guide 9 and/or deflector blade 9*b* is configured such that ice forced through opening 9*a* pushes on ice already on the cold plate, causing the ice to move, and allowing the new, or "fresh" ice to be directed to toward the portion of the cold plate where maximum thermal transfer takes place. Continued rotation of the agitator forces more ice through ice guide 9 into chute 8, and causes ice on the upper surface of the cold plate to continue to be moved by the force provided from the ice movement blades. When no more ice can move through opening 12 onto the upper surface of the cold plate, the agitator acts only to agitate the ice in ice bin 10 and move ice upward toward dispenser 15. Upon contact with the upper surface of cold plate 1, thermal transfer occurs between the ice and liquid beverage disposed in the beverage lines between beverage inlet ports 3 and beverage outlet ports 4. The beverage in the beverage lines remains cool, and the ice therefore melts and turns to water. Due to the incline of upper surface 2, the melted ice runs downward along the incline towards drain trough 5, through the open edge defined by protrusions 6*a*. Edges 6 act to prevent water from running over the sides of the cold plate, and to secure chute 8 in position. A lower edge 8*b* of chute 8, corresponding to the lower open edge of the cold plate, is configured to allow the water to seep underneath the edge into drain trough 5. Lower edge 8*b* is also designed such that ice is prevented from entering and clogging the drain trough. Drain trough 5 is connected to a drainage tube or passage (not shown) to remove melted ice (in liquid form) from the system. When switch 14 is not being actuated, agitator 11 is not rotated, and there is no agitation or movement of ice either in ice storage bin 10, ice guide 9, or along upper surface 2 of cold plate 1. When a user desires beverage, a drinking cup or vessel is placed at ice dispenser port 15, and switch 14 is actuated to dispense ice therefrom. Agitator 11 is rotated by motor 13 to agitate the ice in ice storage bin 10, to force ice downward through opening 12 and ice guide 9 towards the upper surface 2 of cold plate 1, and the ice on upper surface 2 of cold plate 1 is also forced to move by the force of the new ice being pushed downward by agitator 11. This force causes the "old" ice on upper surface 2 to be moved, thereby breaking up any bridged ice particles which may have resulted in any bridging effect which has occurred between the partially melted ice particles thereupon. The ice guide guides the new ice toward the upper and/or central portions of the cold plate, thereby ensuring that the fresh ice is available to cool the warmest beverage, which is located towards inlet ports 3. The inlet ports and the outlet ports, in combination with the serpentined beverage lines, are configured such that maximum efficiency of thermal transfer occurs between the ice on the cold plate and the beverage in the beverage lines therewithin.

Chute 8, as shown in FIG. 2, is configured such that a greater amount of ice is held toward the upper portion of the inclined upper surface, to provide greater cooling capacity near the inlet side of the beverage lines. The lower portion of the chute, therefore, is smaller to ensure that only the smaller, partially melted ice particles move downward toward the bottom portion of the inclined surface of the cold plate, where less thermal transfer is required. As the ice turns to water, the water runs into drain trough 5, and away from the system through the drainage passage.

It is readily apparent that the above-described invention has the advantage of wide commercial utility. It is understood that the specific form of the invention hereinabove described is intended to be representative only, as certain modifications within the scope of these teachings will be apparent to those skill in the art. Accordingly, in determining the full scope of the invention, reference should only be made to the following claims.

We claim:

1. A beverage cooling system, comprising:

an ice storage bin having a mechanical agitator disposed therein, said ice storage bin having an opening at a bottom portion thereof, said mechanical agitator being actuable to mechanically agitate ice in said ice bin and mechanically direct and force ice downward through said opening;

an ice guide disposed adjacent said opening in said ice storage bin;

a cold plate assembly disposed under said ice guide, said cold plate assembly including a cold plate having an inclined upper surface thereof, said cold plate also including at least one beverage line disposed underneath said inclined upper surface;

wherein said ice guide is positioned to deflect and guide ice onto said inclined upper surface of said cold plate, wherein said ice is moved on the upper surface by mechanical force provided by an actuation of the agitator.

2. A beverage cooling system as recited in claim 1, wherein said cold plate further comprises a drain trough at a lower portion of said inclined upper surface, said drain trough configured to drain water from said upper surface as the ice thereupon melts as a result of thermal transfer between the ice and the cold plate.

3. A beverage cooling system as recited in claim 2, wherein said inclined upper surface has four edges thereof, with three of the four edges being surrounded by a raised perimeter edge, and wherein a fourth edge is open to allow water to drain from said inclined upper surface into said drain trough.

4. A beverage cooling system as recited in claim 1, wherein said at least one beverage line is serpentined throughout said cold plate, underneath the inclined upper surface thereof.

5. A beverage cooling system as recited in claim 4, wherein a plurality of serpentined beverage lines are provided in said cold plate.

6. A beverage cooling system as recited in claim 5, wherein said cold plate comprises a cast block of thermally conductive material, and wherein said plurality of serpentined beverage lines are encapsulated therein.

7. A beverage cooling system as recited in claim 2, wherein said at least one beverage line is serpentined throughout said cold plate, underneath the inclined upper surface thereof.

8. A beverage cooling system, comprising: an ice storage bin having a mechanical agitator disposed therein, said ice storage bin having an opening at a bottom portion thereof, said mechanical agitator being actuable to mechanically agitate ice in said ice bin and mechanically direct and force ice through said opening:

an ice guide disposed adjacent said opening in said ice storage bin;

a cold plate assembly disposed under said ice guide, said cold plate assembly including a cold plate having an inclined upper surface thereof, said cold plate also including at least one beverage line disposed underneath said inclined upper surface; and a chute disposed underneath said ice guide, said chute enclosing an ice path on the inclined upper surface of the cold plate, said chute preventing ice and water from sliding off of said upper surface of the cold plate, and guiding the water, propelled by gravity toward a drain trough located at a lower portion of said inclined upper surface, said chute being configured to prevent ice from entering the drain trough: wherein said ice guide is positioned to deflect and guide ice onto said inclined upper surface of said cold plate, wherein said ice is moved on the upper surface by mechanical force provided by an actuation of the agitator.

9. A beverage cooling system as recited in claim 1, wherein said agitator is connected to a rotating means for rotating said agitator, said rotating means being selectively actuated and deactuated by a switch.

10. A beverage cooling system as recited in claim 9, wherein said ice storage bin includes an ice dispensing port at a dispensing station thereupon, wherein said switch functions to actuate the agitator to simultaneously dispense ice from said ice dispensing port and force ice through said opening in said bottom portion.

11. A beverage cooling system as recited in claim 8, wherein said ice guide is disposed directly underneath said opening and directly above said chute, said chute having an opening therein corresponding to the opening in the ice storage bin and the ice guide.

12. A beverage cooling system as recited in claim 9, wherein said agitator is configured to force ice through the ice guide onto said inclined upper surface of the cold plate.

13. A beverage cooling system, comprising: an ice storage bin having a mechanical agitator disposed therein, said ice storage bin having an opening at a bottom portion thereof, said mechanical agitator being actuable to mechanically agitate ice in said ice bin and mechanically direct and force ice through said opening:

an ice guide disposed adjacent said opening in said ice storage bin;

a cold plate assembly disposed under said ice guide, said cold plate assembly including a cold plate having an inclined upper surface thereof, said cold plate also including at least one beverage line disposed underneath said inclined upper surface;

wherein said ice guide is positioned to deflect and guide ice onto said inclined upper surface of said cold plate, wherein said ice is moved on the upper surface by mechanical force provided by an actuation of the agitator and;

wherein said ice guide is disposed to deflect and guide said ice from said ice storage bin away from a lower edge of the inclined upper surface of said cold plate.

14. A beverage cooling system as recited in claim 13, wherein said ice guide includes a deflection means to deflect the ice away from a lower edge of the inclined upper surface of the cold plate.

15. A beverage cooling system as recited in claim 8, wherein said chute is configured such that a larger amount of ice is held toward an upper portion of the inclined upper surface of the cold plate than is held toward a lower portion of the upper surface of the cold plate.

16. A beverage cooling system as recited in claim 1, wherein said cold plate assembly is provided with thermal insulation means for preventing undesirable thermal transfer between said cold plate and ambient air, said thermal insulation means covering a portion of said cold plate and a portion of said cold plate assembly.

17. A beverage cooling system, comprising:

an ice source for providing ice for cooling liquid beverages;

ice guide means adjacent a bottom surface of said ice source for guiding ice downward from said ice source;

ice driving means for forcibly moving ice from said ice source toward and forcing said ice downward through said ice guide means;

a cold plate assembly disposed adjacent said ice guide, said cold plate assembly including a cold plate having an inclined upper surface thereof and being configured such that said ice guide deflects and guides said ice onto said inclined upper surface, said cold plate also including at least one beverage line disposed therein;

wherein ice supplied from said ice source cools liquid beverages in said at least one beverage line through thermal transfer occurring between the ice and the liquid beverage in the beverage line, and wherein said ice is moved on said inclined upper surface by force from said ice driving means, and wherein water from melting ice is moved by gravity toward a bottom portion of said inclined upper surface.

18. A beverage cooling system as recited in claim 17, wherein said cold plate further comprises a drain trough at the lower portion of the inclined upper surface, said drain trough being configured to drain the water from the upper surface as the ice thereupon melts as a result of the thermal transfer.

19. A beverage cooling system as recited in claim 18, further comprising a chute disposed underneath said ice guide and adjacent the inclined upper surface of the cold plate, said chute preventing ice and water from sliding off of said cold plate, and guiding said water toward said drain trough.

20. A beverage cooling system as recited in claim 19, wherein said ice source comprises an ice storage bin, and said ice driving means comprises a mechanical agitator rotatably disposed in said ice storage bin.

21. A beverage cooling system as recited in claim 20, wherein said ice is fed to said cold plate from an opening in a central portion of a bottom of said ice storage bin, and said ice guide and said chute cooperate to deflect and feed said ice onto said inclined upper surface of said cold plate.

22. A beverage cooling system as recited in claim 17, wherein said ice driving means is connected to a rotating means for rotating said ice driving means, wherein said agitator rotates to distribute the ice in the ice storage bin, and ensure a smooth flow of ice in the ice guide.

23. A beverage cooling system as recited in claim 17, wherein said ice source includes an ice dispensing port at a dispensing station thereupon, and wherein a switch is provided to selectively actuate and de-actuate the ice driving means, and wherein said ice driving means is configured to simultaneously dispense ice from said ice dispensing port and force ice from said ice source to the inclined upper surface of the cold plate.

24. A beverage cooling system as recited in claim 19, wherein said ice guide is disposed directly underneath said ice source and directly above said chute, said chute having an opening therein corresponding to an opening in the ice guide.

25. A beverage cooling system, comprising: an ice source for providing ice for cooling liquid beverages;

ice guide means adjacent said ice source for guiding ice from said ice source;

ice driving means for forcibly moving ice from said ice source toward and through said ice guide means;

a cold plate assembly disposed adjacent said ice guide, said cold plate assembly including a cold plate having an inclined upper surface thereof and being configured such that said ice guide deflects and guides said ice onto said inclined upper surface, said cold plate also including at least one beverage line disposed therein; wherein ice supplied from said ice source cools liquid beverages in said at least one beverage line through thermal transfer occurring between the ice and the liquid beverage in the beverage line, and wherein said ice is moved on said inclined upper surface by force from said ice driving means, and wherein water from melting ice is moved by gravity toward a bottom portion of said inclined upper surface; and wherein said ice guide is disposed to deflect and guide said ice toward an inlet side of said at least one beverage line of said cold plate.

26. A beverage cooling system, comprising:

an ice storage bin having a mechanical agitator disposed therein, said ice storage bin having an opening at a bottom portion thereof, said mechanical agitator being actuable to mechanically agitate ice in said ice bin and mechanically direct and force ice through said opening, said ice storage bin including an ice dispensing port at a dispensing station thereupon, such that when said agitator is actuated, ice is simultaneously dispensed from said ice dispensing port, forced through said ice opening, and agitated within the ice storage bin;

an ice guide disposed adjacent said opening in said ice storage bin, said ice guide including a deflection means for deflecting and guiding ice from said ice storage bin;

a cold plate assembly disposed under said ice guide, said cold plate assembly including a cold plate having an inclined upper surface thereof, said cold plate also including at least one beverage line disposed underneath said inclined upper surface, said cold plate further comprising a drain trough at a lower portion of said inclined upper surface, said drain trough configured to drain water from said upper surface as the ice thereupon melts as a result of thermal transfer between the ice and the cold plate, and wherein said at least one beverage line is encapsulated within said cold plate;

a chute disposed underneath said ice guide, said chute enclosing an ice path on the inclined upper surface of the cold plate, said chute preventing ice and water from sliding off said upper surface of the cold plate, and guiding the water, propelled by gravity, toward the drain trough, said chute being configured to prevent ice from entering the drain trough;

wherein said ice guide is positioned to deflect and guide ice from said ice storage bin onto said inclined upper surface of said cold plate, wherein said ice is moved on the upper surface by mechanical force provided by an actuation of the agitator.

* * * * *